US005304084A

United States Patent [19]

Liao

[11] Patent Number: 5,304,084

[45] Date of Patent: Apr. 19, 1994

[54] AUDIBLE COIN BANK

[76] Inventor: Fu-Chiang Liao, c/o Hung Hsing Patent Service Center, P.O. Box 55-1670, Taipei (10477), Taiwan

[21] Appl. No.: 970,173

[22] Filed: Nov. 2, 1992

[51] Int. Cl.[5] ..... G11B 31/00; A45C 1/12

[52] U.S. Cl. ..... 446/9; 446/175; 446/404; 369/63; 232/4 R

[58] Field of Search ..... 369/63, 64; 446/8, 9, 446/10, 11, 12, 13, 175, 404; 232/9 R; 361/331, 380, 390, 391, 422

[56] References Cited

U.S. PATENT DOCUMENTS

| | | | |
|---|---|---|---|
| 528,277 | 10/1894 | Porter | 446/9 |
| 2,952,093 | 4/1958 | Matthay | 446/9 |
| 3,258,100 | 6/1966 | Taff | 446/9 |
| 3,384,378 | 5/1968 | Allen | 369/63 |
| 3,667,136 | 6/1972 | Goodkind et al. | 446/10 |
| 4,637,007 | 1/1987 | Sakurai | 446/175 |

FOREIGN PATENT DOCUMENTS 57-19691 2/1982 Japan .

OTHER PUBLICATIONS

"#605 Ruppert Play-n-Save Talking Bank", Mascon Toy Co. Catalog, Mar. 10, 1966.

*Primary Examiner*—Stuart S. Levy
*Assistant Examiner*—Paul J. Ditmyer

[57] ABSTRACT

An audible coin bank includes: a hollow container (1) having a dropping slot (11) formed in an upper portion of the container for dropping coins (3) into the container through the slot (11) and a bottom hole (12) formed in a bottom portion of the container, and a casing (20) having a battery-powered audio-actuating device (2) plugged in the bottom hole (12) of the container, which will receive a sound signal of an impacting sound caused by a coin (3) impacting upon a sensor (21) of the audio-actuating device or caused by a mutual impact of the dropping coin (3) with the other coins deposited in the container for producing a voice or music melody by a voice or music producing integrated circuit for entertaining purpose, and wherein the batteries (26) stored in the casing may be replaced or renewed directly from the casing (20) plugged in the bottom portion of the container for prolonging a service life of the coin bank.

2 Claims, 3 Drawing Sheets

AUDIBLE COIN BANK

BACKGROUND OF THE INVENTION

A conventional coin bank or piggy bank owned by a child is provided for depositing or inserting coins into a container through a slot formed in an upper portion of the bank container for saving his or her coins or money.

The coin bank may be installed with an electronic circuit device such as a voice generator in the container having a sensor provided adjacent to the slot for dropping coins therethrough for generating a voice for entertaining the bank owner. However, the electronic circuit device will consume electric energy and should be replaced with fresh batteries for powering the electronic circuit for generating a voice and it is impossible or very difficult to dismantle the electronic circuit device fixed inside the bank container for renewing the batteries or for maintaining the electronic circuit device.

SUMMARY OF THE INVENTION

The object of the present invention is to provide an audible coin bank including: a hollow container having a dropping slot formed in an upper portion of the container for dropping coins into the container through the slot and a bottom hole formed in a bottom portion of the container, and a casing having a battery-powered audio-actuating device plugged in the bottom hole of the container, which will receive a sound signal of an impacting sound caused by a coin impacting upon a sensor of the audio-actuating device or caused by a mutual impact of the dropping coin with the other coins deposited in the container for producing a voice or music melody by a voice or music producing integrated circuit for entertaining purpose, and wherein the batteries stored in the casing may be replaced or renewed directly from the casing plugged in the bottom portion of the container for prolonging a service life of the coin bank.

DETAILED DESCRIPTION

Figure 1:
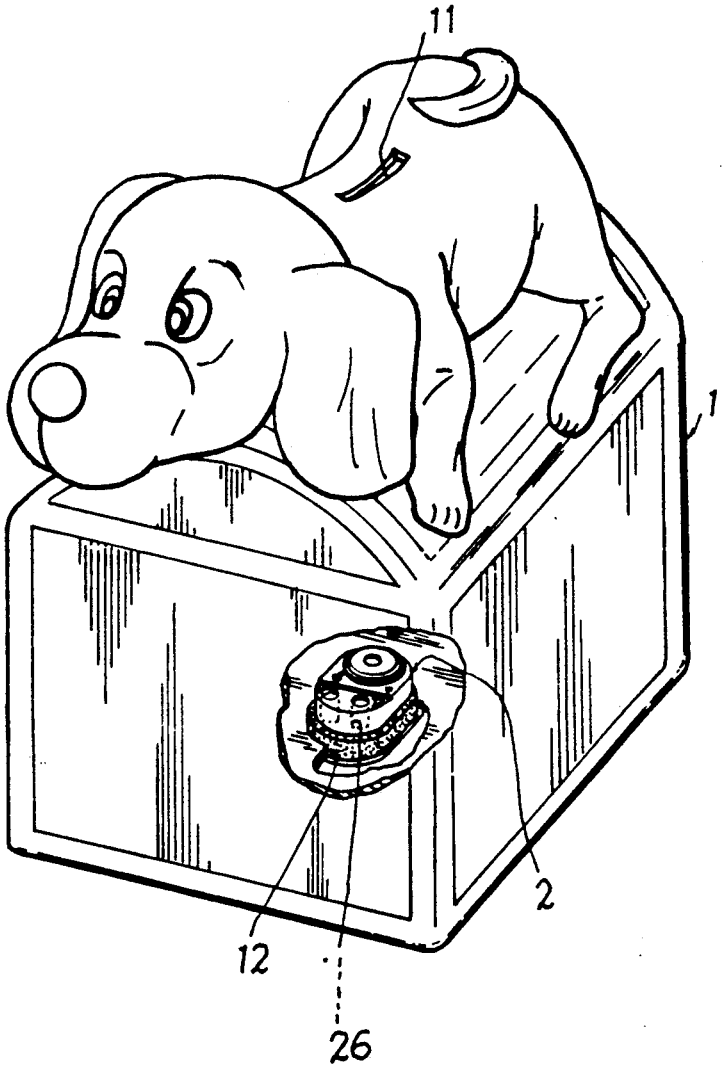
FIG. 1 is a perspective view of the present invention.
Figure 2:
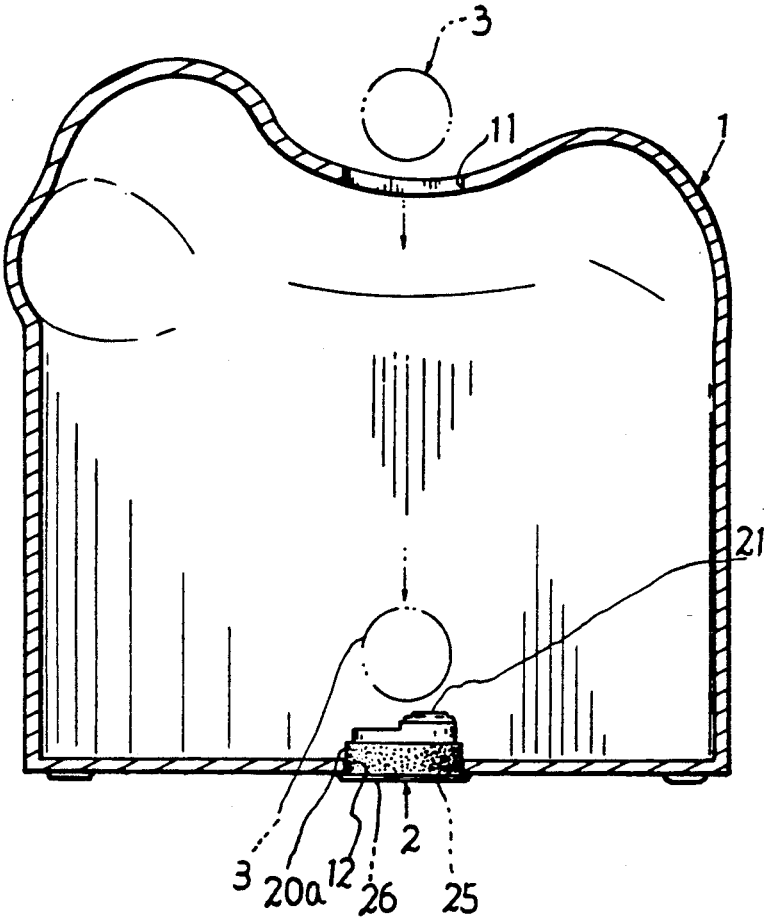
FIG. 2 is a sectional drawing of the present invention.

As shown in the drawing figures, the present invention comprises: a hollow container 1, and an audio-actuating means 2.

The hollow container 1 includes: a dropping slot 11 formed in an upper portion of the container 1 for inserting a coin 3 into the container 1 through the slot 11, and a bottom hole 12 formed in a bottom portion of the container 1.

The shapes, designs, and materials of the container 1 are not limited in this invention.

Figure 3:
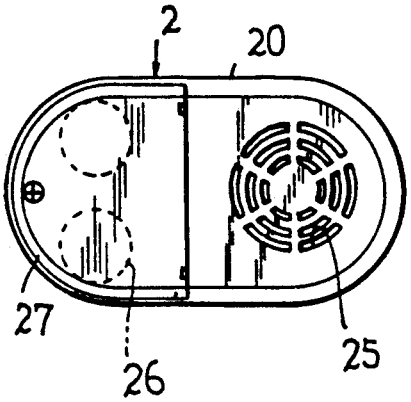
FIG. 3 is a bottom view of a casing of the audio-actuating means of the present invention.
Figure 4:
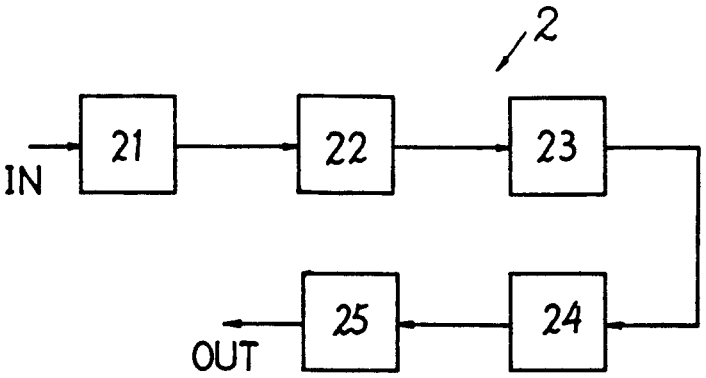
FIG. 4 is a block diagram of an audio-actuating means of the present invention.

The audio-actuating means 2 includes: a casing 20 formed as a bottom plug 20*a* plugged in the bottom hole 12 of the container 1, a sensor 21 formed on an upper portion of the casing 20 for receiving sound signal caused by a dropping coin 3 impacting upon the sensor 21 or caused by mutual impacting between the dropping coin with other coins already deposited in the container 1, a sound-signal filter 22 electrically connected to the sensor 21 for filtering any unexpected interfering sound signals other than a coin impacting sound, an amplifier 23 operatively amplifying the sound signal as filtered from the filter 22, an audio-producing integrated circuit 24 operatively receiving and processing the sound signal amplified from the amplifier 23 for producing voice or music, a speaker 25 for outputting the voice or music outwardly, and a power source of batteries 26 stored in the casing 20 having a battery cover 27 openable from a bottom of the casing 20 as shown in FIG. 3.

The sensor 21 of the audio-actuating means 2 is projectively positioned under the dropping slot 11 of the container to be operatively impacted by a dropping coin 3 through the slot 11 for initiating the audio-actuating means 2 for producing voice and music sounding.

The integrated circuit 24 used in this invention can be selected from a voice generating integrated circuit or music melody integrated circuit available in the markets and are not limited in this invention. A voice-generating integrated circuit (I.C.) with a low-frequency speaker may consume much electric energy than a buzzer of a music melody sounding integrated circuit so that the batteries for powering a voice-generating I.C. may be conveniently replaced with new batteries by opening the cover 27 of the casing 20 of the present invention for enhancing a longer service life of the voice-generating coin bank in accordance with the present invention.

I claim:

1. An audible coin bank comprising:

a hollow container having a dropping slot formed in an upper portion of the container and a bottom hole formed in a bottom portion of said container; and an audio-actuating means powered by a power source of at least a battery and encased by a casing plugged in the bottom hole of said container operatively receiving a sound signal caused by a coin impacting on a sensor of said audio-actuating means and caused by mutual impacting between coins in the container when dropping a coin therein for producing output audio signals of voice and music melody by an audio-producing integrated circuit of said audio-actuating means; said audio-actuating means including: said casing formed as a bottom plug plugged in the bottom hole of the container, said sensor formed on an upper portion of the casing for receiving the sound signal caused by a dropping coin impacting upon the sensor and impacting the other coins deposited in the container, a sound-signal filter electrically connected to the sensor for filtering any unexpected interfering sound signals other than a coin impacting sound, and amplifier operatively amplifying the sound signal as filtered from the filter, said audio-producing integrated circuit operatively receiving and processing the sound signal amplified from the amplifier for producing voice and music, a speaker for outputting the voice and music outwardly, and said power source of at least a battery stored in the casing having a battery cover openable from a bottom of the casing for replacing said battery in the casing.

2. An audible coin bank according to claim 1, wherein said sensor of the audio-actuating means is projectively positioned under the dropping slot of the container to be operatively impacted by a dropping coin inserted through the slot for initiating the audio-actuating means for producing voice and music.

* * * * *